US007261523B2

(12) United States Patent
Da Silva

(10) Patent No.: US 7,261,523 B2
(45) Date of Patent: Aug. 28, 2007

(54) PUMP SYSTEM FOR DELIVERING PRESSURIZED LIQUID

(76) Inventor: Serafim Felix Da Silva, Rua Rio de Contas, No. 677 Bairro, Brasilia Feira de Sauxana, Cep. 44060-170 (BA) (BR)

( * ) Notice: Subject to any disclaimer, the term of this patent is extended or adjusted under 35 U.S.C. 154(b) by 736 days.

(21) Appl. No.: 10/699,917

(22) Filed: Nov. 3, 2003

(65) Prior Publication Data

US 2005/0095147 A1 May 5, 2005

(51) Int. Cl.
*F04B 17/00* (2006.01)

(52) U.S. Cl. ..... 417/329

(58) Field of Classification Search ..... 417/329
See application file for complete search history.

(56) References Cited

U.S. PATENT DOCUMENTS 1,260,204 A * 3/1918 Keithly ..... 60/640

2,583,528 A * 1/1952 Habsch ..... 417/329

* cited by examiner

*Primary Examiner*—Anthony D. Stashick
*Assistant Examiner*—Jessica Frantz
(74) *Attorney, Agent, or Firm*—Richard M. Goldberg

(57) ABSTRACT

A pump system for providing a pressurized liquid comprising an elevated supply reservoir of a liquid at a first pressure; at least one pair of vertically reciprocating liquid transfer vessels (each of the transfer vessels having a force transfer assembly operatively associated with it that transfers downward force into upward force and a liquid pump operatively associated with the force transfer assembly for delivering liquid at a second pressure that is greater than said first pressure) and a storage reservoir below said supply reservoir for receiving liquid from said supply reservoir and delivering said liquid to each of said liquid pumps. The supply reservoir is adapted to supply the liquid to the transfer vessels under gravity flow, and the liquid applied to said transfer vessels provides the downward force.

11 Claims, 2 Drawing Sheets

PUMP SYSTEM FOR DELIVERING PRESSURIZED LIQUID

BACKGROUND OF THE INVENTION

The present invention relates to pump systems for delivering pressurized liquid.

SUMMARY OF THE INVENTION

The pump system of the present invention for providing a pressurized liquid comprises a. an elevated supply reservoir of a liquid at a first pressure;

b. at least one pair of vertically reciprocating liquid transfer vessels, each of said transfer vessels having i) a force transfer assembly operatively associated with it that transfers downward force into upward force; and ii) a liquid pump operatively associated with said force transfer assembly for delivering liquid at a second pressure that is greater than said first pressure; and c. A storage reservoir below said supply reservoir for receiving liquid from said supply reservoir and delivering said liquid to each of said liquid pumps, said supply reservoir being adapted to supply said liquid to said transfer vessels under gravity flow, and said liquid applied to said transfer vessels providing said downward force.

DESCRIPTION OF THE PREFERRED EMBODIMENTS

The pump system 1 of the present invention provides a supply of pressurized liquid. It comprises a) an elevated supply reservoir of a liquid at a first pressure; b) at least one pair of vertically reciprocating liquid transfer vessels, each of said transfer vessels having: i) a force transfer assembly operatively associated with it that transfers downward force into upward force and ii) a liquid pump operatively associated with said force transfer assembly for delivering liquid at a second pressure that is greater than said first pressure; and c) a storage reservoir below said supply reservoir for receiving liquid from said supply reservoir and delivering said liquid to each of said liquid pumps, said supply reservoir being adapted to supply said liquid to said transfer vessels under gravity flow, and said liquid applied to said transfer vessels providing said downward force.

The present invention seeks to provide a means for pumping liquid in remote, primitive areas and providing liquid at elevated pressure without the use of a motor or other external propulsion force. It seeks to provide an effective means for providing compressed liquids, such as potable water, in rural, industrial and domestic environs. It also seeks to provide compressed liquids without electrical energy and pumping liquids without expending fuel so as to provide compressed liquids in a self-sufficient manner and without needing any type of fuel. Further, the pump system of the present invention seeks to provide a beneficial source of water for irrigation systems and other similar systems in remote areas. The present invention seeks to provide a means for pumping liquid thereby providing liquid at elevated pressure without the use of a motor or other external propulsion force.

Figure 1:
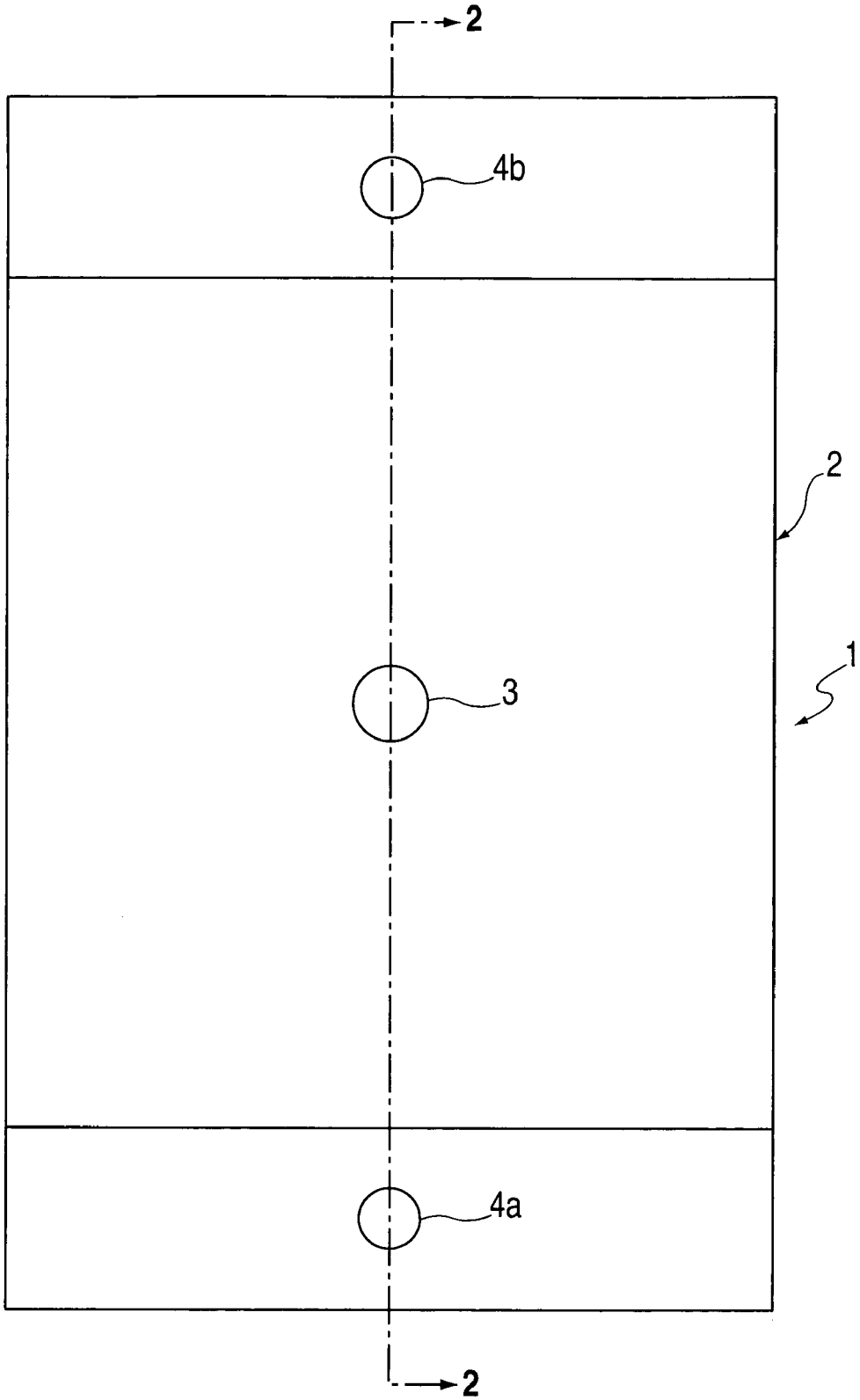
FIG. 1 is a top plan view of the pump system of the present invention.
Figure 2:
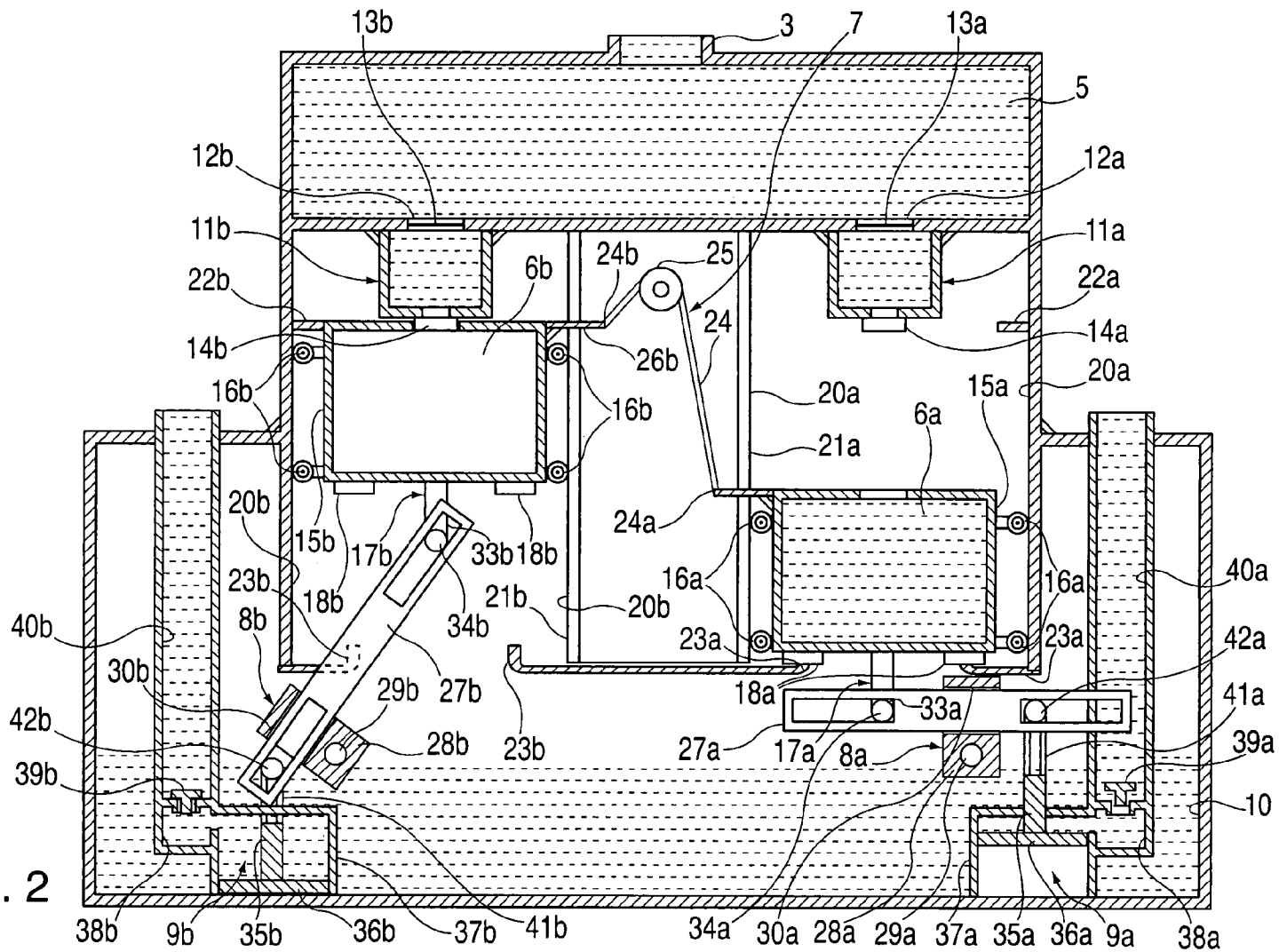
FIG. 2 is a side elevation view of the pump system of the present invention, in section taken along the line 1-1 in FIG. 1.

In the pump system 1 of the present invention, and as illustratively shown in FIGS. 1 and 2, a sealed main box 2 encloses the component elements of the pump system 1 and seals them from ambient atmospheric pressure. A liquid, such as water, oil, etc., is supplied to the pump system 1 at a first pressure, such as ambient pressure, through inlet 3. The pump system 1, through the agency of its components, then increases the pressure of the liquid to a greater pressure (herein referred to as a pressurized liquid) within the sealed box 2 and delivers the pressurized liquid from an outlet 4 (shown in FIG. 1 as a pair of spaced outlets 4*a* and 4*b*.). The main component elements (FIG. 2) of the pump system of the present invention are a supply reservoir 5, a plurality of reciprocating liquid vessels 6*a* and 6*b*, a vessel-elevation assembly 7, a plurality of force-transfer assemblies 8*a* and 8*b* corresponding to the liquid vessels, a plurality of single-action liquid pumps 9*a* and 9*b* corresponding to the force-transfer assemblies, and a lower storage reservoir 10.

During operation of the pump system 1, liquid flows into supply reservoir 5 where it is held for supply and internal distribution in the system. Liquid flows by gravity from the supply reservoir 5 into a first reciprocating liquid vessel 6*a* and fills that vessel. Upon filling, the vessel 6*a* descends by gravity and applies a downward force to its associated force-transfer assembly 7*a*. The force-transfer assembly 7*a* rotationally converts that downward force into an upward force on the associated single action pump 9*a*. This upward force acting on the single action pump 9*a* pumps liquid drawn from the lower storage reservoir 10 out of the pump system 1 through outlet 4*a* providing compressed liquid. When the vessel 6*a* has descended to the bottom of its vertical travel, it exhausts its volume of liquid into the lower storage reservoir 10 for use as a supply to single action pumps 9*a* and 9*b*. The descent of vessel 6*a* acts through the vessel-elevation assembly 7 to raise vessel 6*b* (which is empty) into position to receive liquid from supply reservoir 5.

The sealed box 2 is a sealed container, preferably of stainless steel, and is preferably configured generally as a rectangular prism with opposed side extensions that house the lower storage reservoir 10 and the exhaust sides of the liquid pumps 9*a* and 9*b*. This provides the sealed box 2 with a broad base to resist tipping. In front elevation the box 2 has an inverted "T" configuration. A centrally disposed inlet 3 is provided in the top wall for liquid ingress and a pair of outlets 4*a* and 4*b* are disposed in association with reflective liquid pumps 9*a* and 9*b*.

The supply reservoir 5 holds liquid for supply to the reciprocating transfer vessels 6*a* and 6*b*. It is elevated above the lower storage reservoir 10 and the reciprocating transfer vessels 6*a* and 6*b* so that the liquid can flow by gravity from the supply reservoir 5 to the storage reservoir 10 via the transfer vessels 6*a* and 6*b* and that liquid can be used as a motive force to drive the pumps 9*a* and 9*b*. The liquid flows by gravity from the reservoir 10 into a set of supply manifolds 11*a* and 11*b*. Drain ports 12*a* and 12*b* from the supply reservoir 5 are each supplied with a filter 13*a* and 13*b* so that the liquid exiting the supply reservoir 5 is filtered of debris, sediment, etc. Each supply manifold 11*a* and 11*b* is provided with a normally closed dispensing valve 14*a* and 14*b* that is opened by the corresponding transfer vessel 6*a* engaging its lower surface. (See FIG. 2, element 14*a*.)

Each of reciprocating liquid transfer vessels 6*a* and 6*b*comprises an enclosed box 15*a* and 15*b*, preferably of aluminum, for holding the liquid in its downward travel, a set of guide wheels 16*a* and 16*b*, a depending connecting rod 17*a* and 17*b* and a set of exhaust valves 18*a* and 18*b*. The top wall of each box 15*a* and 15*b* is provided with an entry aperture 19*a* and 19*b* through which the liquid enters the box 15*a* and 15*b* from the corresponding dispensing valve 14*a* or 14*b*. The enclosed box 15*a* or 15*b* contains the held liquid during its descent. The guide wheels 16*a* and 16*b*, preferably of nylon polymer, engage and are guided by the guide walls 20*a* and 20*b* in the sealed box 2, the guide walls defining a pair of corresponding guide shafts 21*a* and 21*b*, preferably of steel. Each guide shaft 21*a* or 21*b* is provided on its interior with a lever. The bottom wall of the enclosed box 15*a* or 15*b* is provided with a centrally disposed connecting rod 17*a* or 17*b* for operatively connecting the transfer vessel 6*a* or 6*b* to its corresponding force-transfer assembly 8*a* or 8*b*. The bottom wall is also provided with a set of peripherally disposed exhaust valves 18*a* or 18*b* that are spaced slightly inwardly of the side walls of the box 15*a* or 1. Sb to clear those side walls. The exhaust valves 18*a* and 18*b* (which are normally closed) act as outlets from the transfer vessels 6*a* and 6*b* and control the flow of liquid out of the transfer vessels 6*a* and 6*b* and into the lower storage reservoir 10. These sets of exhaust valves 18*a* or 18*b* are opened by the engagement of their lower surfaces against a set of stops 23*a* or 23*b* extending upwardly from the bottom of each of the guide shafts.

The vessel elevation assembly 7 comprises a flexible cable 24, preferably of nylon polymer, (or chain) and a pulley 25. The pulley 25 is mounted with a horizontal axis of rotation between the guide shafts 21*a* and 21*b* and their associated transfer vessels 6*a* and 6*b*. The flexible cable 24 passes over the pulley 25 and is supported by it. Each of the free ends of the cable 24*a* and 24*b* is attached to a corresponding transfer vessel 6*a* and 6*b* respectively by an extension 26*a* and 26*b* extending outwardly from the boxes 15*a* and 15*b*. In this way, the downward movement of one transfer vessel, such as 6*a*, will pull the other transfer vessel 6*b* up and vice versa.

Each of the force assemblies 8*a* and 8*b* that correspond with their respective reciprocating vessels 6*a* and 6*b* comprise a slotted sliding link bar 27*a* and 27*b*, a slotted pivot bar 28*a* and 28*b* and a pivot shaft 29*a* and 29*b*. The pivot shaft 29*a* or 29*b* is mounted for the axis of rotation of the pivot bar 28*a* and 28*b* to be horizontal and parallel to the axis of rotation of the pulley 25. Pivot bar 28*a* and 28*b*, preferably of bronze, is each mounted with its plane of rotation parallel to that of the pulley 25. The pivot bar 28*a* and 28*b* is provided with a transverse slot 30*a* or 30*b* through which the sliding bar 27*a* or 27*b* slides and is retained so that the sliding bar 27*a* or 27*b* slides in a plane that is parallel to the plane of rotation of the pivot bar 28*a* or 28*b*. The transverse slot 30*a* or 30*b* is radially offset from the axis of rotation of the pivot bar 28*a* or 28*b*. The transverse slot 30*a* or 30*b* is rectangular in cross-section. Each sliding bar 27*a* and 27*b*, preferably of extruded steel, is provided with a proximal rectangular slot 31*a* or 31*b* and a distal rectangular slot 32*a* or 32*b*, as the case may be. The connecting rod 17*a* and 17*b* of each transfer vessel is provided with a slot 33*a* or 33*b* at its end that is closed by a cross-shaft 34*a* or 34*b*. The cross-shaft 34*a* and 34*b* passes through the proximal slot 30*a* and 30*b* and allows the downward force of the transfer vessel 6*a* or 6*b* to be transferred to the force-transfer assembly 8*a* or 8*b*, respectively. Each cross-shaft 34*a* or 34*b* slides in proximal slot 31*a* or 31*b* and the sliding link bar 27*a* or 27*b* pivots or rotates with respect to the connecting rod 17*a* or 17*b* during the reciprocating movement of the transfer vessels 6*a* and 6*b*. Similarly, the connecting rod of the piston of each pump 9*a* and 9*b* is provided with a transverse rectangular slot at its upper end that is closed by a cross shaft that passes through the distal slot 32*a* and 32*b* and allows the downward force of the sliding link bar to be transferred to the piston of the pump through the pump connecting rod.

Each of the single-action liquid pumps 9*a* and 9*b* is a vertical stroke pump, meaning that it delivers liquid during its upward vertical stroke, and comprises a piston connecting rod 35*a* and 35*b*, a piston 36*a* and 36*b*, a pump cylinder 37*a* and 37*b*, an exhaust manifold 38*a* and 38*b*, a one-way, poppet regulator valve 39*a* and 39*b* and an exhaust pipe 40*a* and 40*b*. The upper end of each piston connecting rod is provided with a transverse slot 41*a* and 41*b* that is closed by a cross shaft 42*a* and 42*b*. The distal slot 32*a* and 32*b* of each link bar 27*a* and 27*b* slides and rotates on this cross shaft in transferring force from the force-transfer assembly 8*a* and 8*b* to the pump 9*a* and 9*b*. The connecting rod 35*a* and 35*b* is centrally disposed with respect to and fixed to the piston 36*a* and 36*b*. Piston 36*a* and 36*b* is disposed in, and rides in, cylinder 37*a* and 37*b*. Liquid enters the cylinder 37*a* or 37*b* through valve means (not shown) and is forced out of the cylinder 37*a* or 37*b* by the upward movement of the piston 36*a* or 36*b* and through exhaust manifold 38*a* or 38*b*, respectively. The poppet regulator valve 39*a* or 39*b* controls flow out of the exhaust manifold 38*a* or 38*b*, respectively, and prevents return flow of liquid into the cylinder 37*a* or 37*b* through the manifold 38*a* or 38*b* during the downstroke of the piston 36*a* and 36*b*. The liquid exits the pump 9*a* and 9*b* as a compressed liquid at a pressure elevated above the pressure of the supply reservoir by the force multiplier action of the force transfer assembly 7*a* and 7*b*. This force multiplier action results from the distance between the axis of cross shaft 34*a* (or 34*b*) and that of pivot shaft 29*a* (or 29*b*) being greater than the distance between the axis of cross shaft 42*a* (or 42*b*) and that of pivot shaft 29*a* (or 29*b*.)

The lower storage reservoir 10 comprises the bottom wall and the lower portions of the front, back and outer side walls of the sealed box 2. It acts as a sump for holding the liquid exhausted from transfer vessels 6*a* and 6*b* as the gravity feed of the liquid from the supply reservoir 5 to the storage reservoir 10 is recovered as motive force for the pumps 9*a* and 9*b* to provide compressed liquid.

In operation, liquid flows under gravity into the supply reservoir 5 and fills the supply manifolds 11*a* and 11*b* through drain ports 12*a* and 12*b*. Preferably, this outlet liquid is filtered of debris and particulates by filters 13 so that such debris and/or particulates does not clog or otherwise impair the functioning of downstream vessels, piping and valving.

From the supply reservoir 5, a volume of filtered liquid passes through the supply manifold 11*a* and out the dispensing valve 14*a* into a reciprocating transfer vessel. The filtered liquid fills the transfer vessel 6*a* until the weight of the volume of liquid in the transfer vessel 6*a* overcomes the resistance of the force transfer assembly 8*a* and the associated pump 9*a*.

At that point, the liquid-filled transfer vessel 6*a* descends down the guide shaft 21*a* until it reaches the bottom of the shaft. Stops 23*a* at the bottom of the guide shaft 21*a* engage receptacle exhaust valves 18*a* and the weight of the receptacle 6*a* and the liquid in it opens them, the liquid flows out of the transfer vessel 6*a* and into the storage reservoir 10.

Meanwhile, during the descent of the transfer vessel 6*a*, the force of the weight of the liquid and the transfer vessel 6*a* and the downward movement of the transfer vessel 6*a* have pushed the force transfer link bar 27*a* down and driven the other end of the bar 27*a* up. This lifts the piston rod 35*a* of the pump 9*a* up and its connected piston 36*a* up.

The upward movement of the piston 36*a* forces liquid, under elevated pressure, through one-way, poppet regulator valve 39*a* up the exhaust pipe 40*a* and out the outlet 4*a*.

When one reciprocating vessel, such as transfer vessel 6*a*, is full of liquid, the other transfer vessel 6*b* is empty. The filled transfer vessel 6*a* releases itself from dispensing valve 14*a* of the supply manifold 11*a* of supply reservoir 5 and it drops while the empty reciprocating vessel 6*b* that is down rises and returns to its upper position to fill with liquid from supply reservoir 5. This alternating reciprocating movement of the reciprocating vessels 6*a* and 6*b* provides an alternating lineal movement and alternating downward force that is translated, by respective force-transfer assemblies 8*a* and 8*b*, to reciprocating lineal force for driving the respective pumps 9*a* and 9*b*. The force-transfer assemblies 8*a* and 8*b* multiply the downward force of respective reciprocating vessels 6*a* and 6*b* in driving their associated vertical stroke, single action pumps 9*a* and 9*b*.

While the pump system of the present invention has been described with respect to a single unit or sealed box and a single pair of liquid transfer vessels, force transfer assemblies, and liquid pumps, the pump system may also take the form of multiple units in parallel or in series or in the form of multiple pairs of liquid transfer vessels, force transfer assemblies, and liquid pumps.

The features of the invention illustrated and described herein is the preferred embodiment. Therefore, it is understood that the appended claims are intended to cover the variations disclosed and unforeseeable embodiments with insubstantial differences that are within the spirit of the claims.

The invention claimed is:

1. A pump system for providing a pressurized liquid comprising:

a. an elevated supply reservoir of a liquid at a first pressure;

b. at least one pair of vertically reciprocating liquid transfer vessels, each of said transfer vessels having:

i) a force transfer assembly operatively associated with it that transfers downward force into upward force; and ii) a liquid pump operatively associated with said force transfer assembly for delivering liquid at a second pressure that is greater than said first pressure; and c. a storage reservoir below said supply reservoir for receiving liquid from said supply reservoir and delivering said liquid to each of said liquid pumps, said supply reservoir being adapted to supply said liquid to said transfer vessels under gravity flow, said liquid applied to said transfer vessels providing said downward force, and wherein:

a. said at least one pair of transfer vessels, b. each of said liquid pumps, c. each of said force assemblies and d. said storage reservoir are disposed within a sealed container.

2. A pump system as recited in claim 1 wherein said elevated supply reservoir is also disposed within said sealed container.

3. A pump system as recited in claim 1 wherein said first pressure is atmospheric pressure.

4. A pump system as recited in claim 1 wherein said pair of transfer vessels is adapted to alternately rise and lower.

5. A pump system as recited in claim 1 wherein said pump system further comprises a transfer vessel elevation assembly for alternately raising one of said pair of transfer vessels while the other of said pair of transfer vessels descends.

6. A pump system as recited in claim 1 wherein said liquid pump comprises a vertical stroke, single-action pump.

7. A pump system as recited in claim 1 wherein an upward vertical stroke of said pump delivers said liquid at a second pressure that is greater than said first pressure.

8. A pump system as recited in claim 1 wherein said supply reservoir comprises a plurality of dispensing valves in liquid communication with said supply reservoir and controlling outflow of said liquid from said supply reservoir.

9. A pump system as recited in claim 1 wherein said dispensing valves correspond in number to the number of said transfer vessels.

10. A pump system as recited in claim 1 wherein each of said transfer vessels comprises at least one exhaust valve in liquid communication with the interior of said transfer vessel and controlling outflow of said liquid from said vessel.

11. A pump system as recited in claim 10 wherein there are a plurality of said exhaust valves associated with each of said transfer vessels.

* * * * *